US006720538B2

(12) United States Patent
Lev

(10) Patent No.: US 6,720,538 B2
(45) Date of Patent: Apr. 13, 2004

(54) THERMOSTAT VARIATION COMPENSATING KNOB

(75) Inventor: Mordechai Lev, Northville, MI (US)

(73) Assignee: HoMedics, Inc., Commerce Township, MI (US)

( * ) Notice: Subject to any disclaimer, the term of this patent is extended or adjusted under 35 U.S.C. 154(b) by 298 days.

(21) Appl. No.: 09/884,010

(22) Filed: Jun. 18, 2001

(65) Prior Publication Data

US 2002/0190058 A1 Dec. 19, 2002

(51) Int. Cl.[7] ..... H05B 1/02; H01C 10/50; H01H 71/00

(52) U.S. Cl. ..... 219/512; 338/200; 337/3

(58) Field of Search ..... 219/509, 510, 219/512, 490, 491; 337/3, 10, 12, 13, 16, 85, 101, 103; 338/200

(56) References Cited

U.S. PATENT DOCUMENTS

| | | | | |
|---|---|---|---|---|
| 3,183,738 A | | 5/1965 | Hollister | |
| 3,395,375 A | | 7/1968 | Risk et al. | |
| 3,564,206 A | * | 2/1971 | Lauck, III | 219/501 |
| 3,633,143 A | * | 1/1972 | Yoshimura | 337/366 |
| 3,767,880 A | | 10/1973 | Austin | |
| 4,082,388 A | | 4/1978 | Goeglein | 312/258 |
| 4,096,376 A | * | 6/1978 | Macklem | 392/448 |
| 4,125,767 A | * | 11/1978 | Silver | 250/214 D |
| 4,250,397 A | * | 2/1981 | Gray et al. | 392/435 |
| 4,355,544 A | | 10/1982 | Post | |
| 5,424,199 A | * | 6/1995 | Goeddel et al. | 200/11 R |
| 5,467,523 A | | 11/1995 | Seaman | |
| 5,524,527 A | | 6/1996 | Dumoux et al. | |
| 5,759,644 A | | 6/1998 | Stanley | 428/14 |
| 5,803,562 A | | 9/1998 | Jacobs | 312/283 |
| 5,943,917 A | | 8/1999 | Truong et al. | |

* cited by examiner

*Primary Examiner*—Sang Paik
(74) *Attorney, Agent, or Firm*—Brooks Kushman P.C.

(57) ABSTRACT

A heating appliance having an electrical circuit that controls the temperature output of the heating appliance is provided with a bimetallic element that opens upon reaching a temperature level. A potentiometer in the circuit is used to select the temperature level within an acceptable range of temperatures. The potentiometer has a rotatable shaft including a first positioning element. A knob is secured to the shaft and has a second positioning element that engages the first positioning element on the shaft. The first and second positioning elements have portions that may be modified to compensate for variations in the temperature at which the bimetallic element opens. The first positioning element may be a rib, while the second positioning element is a slot in a tubular portion of the knob receives the rib and that may be located in a range of arcuate positions.

9 Claims, 2 Drawing Sheets

THERMOSTAT VARIATION COMPENSATING KNOB

BACKGROUND OF THE INVENTION

1. Field of the Invention

The present invention relates to a knob for a thermostatic control that has positioning elements having portions that may be modified to compensate for variations in the temperature at which the bimetallic element opens and a method of providing an adjustable thermostatic control for a heating appliance.

2. Background Art

Household appliances and other devices having thermostatic heat controls are widely used in devices such as water baths, paraffin baths, electric heaters, and other household and kitchen appliances. The heat control for an appliance may include a thermostatic element comprising a bimetallic strip having a contact that opens the circuit and interrupts current supplied for heating the appliance to a desired temperature.

Such bimetallic thermostat elements may be obtained that are capable of sensing temperatures with different degrees of accuracy. Generally, more precise bimetallic elements can provide heat control within a few degrees or even fractions of degrees. Generally, more precise or limited temperature range bimetallic thermostatic elements will be more expensive. To provide cost effective thermostatic control for household appliances, the use of bimetallic elements having a temperature tolerance of plus or minus 8–10° F. has been proposed. By way of example, bimetallic thermostatic elements having a temperature specification of 128° F. and a tolerance specification of plus or minus 8° F. were unsatisfactory for use in paraffin baths because the thermostats would permit temperatures to range from 120° F. to 136° F. Use of such broad tolerance thermostats was considered unacceptable since at the low end of the temperature range the paraffin wax is slow to melt while at the upper end of the temperature range the bath would be uncomfortable to a user. The ideal temperature range of between 126° F. and 131° F. was not possible to assure with broad tolerance bimetallic elements. While more expensive lower tolerance thermostatic elements could be specified they would tend to add substantially to the cost of the appliance.

What is needed is a method and apparatus for providing thermostatic heat control for a household appliance utilizing broad tolerance bimetallic thermostatic elements while providing heat control within the more narrow range than the range of potential tolerance of the bimetallic thermostatic element.

These and other problems shortcomings to the prior art are addressed by Applicant's invention as summarized below.

SUMMARY OF THE INVENTION

According to the present invention, a thermostatic control is provided for heating an appliance having an electrical circuit for controlling the heating appliance including a bimetallic element. A potentiometer is provided in the circuit for selecting the temperature level within an acceptable range of temperatures. The potentiometer has a rotatable shaft having a first positioning element. A knob is secured to the shaft and has a second positioning element that engages the first positioning element. The first and second positioning elements have portions that may be modified to compensate for variations in the temperature at which the bimetallic element opens.

According to another aspect of the invention, the first positioning element on the rotatable shaft may be a rib and the second positioning element may be a tubular portion of the knob having a slot that receives the first positioning element. Further, the slot of the second positioning element may be located within a range of radial locations. For example, three different types of knobs may be provided with the slot being located in one of three radial locations to compensate for variations in the temperature at which the bimetallic element opens.

According to another aspect of the invention, the heating appliance may include a housing with at least one fixed stop while the knob has at least one end stop that cooperates with the fixed stop to limit rotational movement of the rotatable shaft.

According to another aspect of the invention, the heating appliance may have a control panel having an opening through which the knob is connected to the rotatable shaft. The knob may have projections including detents that rotatably secure the knob to the opening in the control panel.

According to another aspect of the invention, the bimetallic element may have a rated temperature tolerance within a first range of temperatures. If the range of acceptable temperatures for the heating appliance is less than the rated temperature tolerance, the portions of the first and second positioning elements may be selected or arranged to calibrate the potentiometer to fall within the acceptable range of temperatures.

According to yet another aspect of the invention, a two-part knob may be provided including an outer part defining a cavity and an inner part comprising a disk that is received in the cavity. The outer portion may include a tubular portion and the inner portion may have two end stops and two projections including detents for securing the knob to a control panel.

According to the method of the present invention, an adjustable thermostatic control may be provided for a heating appliance that comprises testing a bimetallic element having a contact that opens at a temperature within a range of temperatures. Based upon the testing, the bimetallic elements are sorted into at least two groups depending upon the point within the range of temperatures that the contact opens. A first manual control part that cooperates with a second manual control part is selected that has positioning elements that may be selected to compensate for variations in the temperature at which the bimetallic element opens by setting the location that the first and second manual control parts engage each other.

According to another aspect of the invention, the bimetallic elements may be sorted into three groups including a low range, mid-range, and high range temperature groups.

According to yet another aspect of the method of the present invention, the first manual control part is a knob having a slot formed in a tubular portion thereof and the second manual control part is a rotatable shaft having a rib that is received in the slot. The knob may be made with a slot in different radial positions relative to end stops to establish the location that the first and second manual control parts engage each other.

These and other objects, features, and advantages of the present invention will be better understood in view of the attached drawings and following detailed description of the preferred embodiment.

DETAILED DESCRIPTION OF THE PREFERRED EMBODIMENTS

Figure 1:
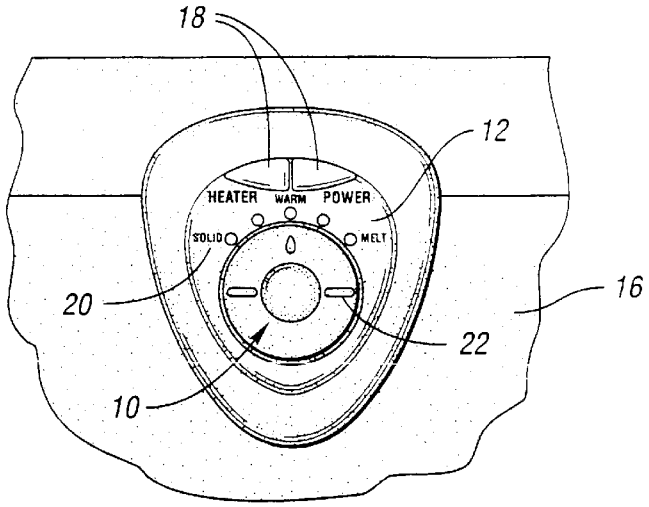
FIG. 1 is a fragmentary front elevation view of a control panel of an appliance including the thermostat variation compensating knob of the present invention.

Referring now to FIG. 1, a knob assembly 10 made in accordance with the present invention is shown in conjunction with a control panel 12 for a paraffin bath 16. The control panel 12 includes indicator lights 18 for indicating whether or not power is on and whether or not the heater is heating. The control panel also includes indicia 20 that indicates the power level or desired temperature setting. The knob assembly 10 includes tabs 22 that may be grasped by a user's fingers to facilitate turning the knob 10.

Figure 2:
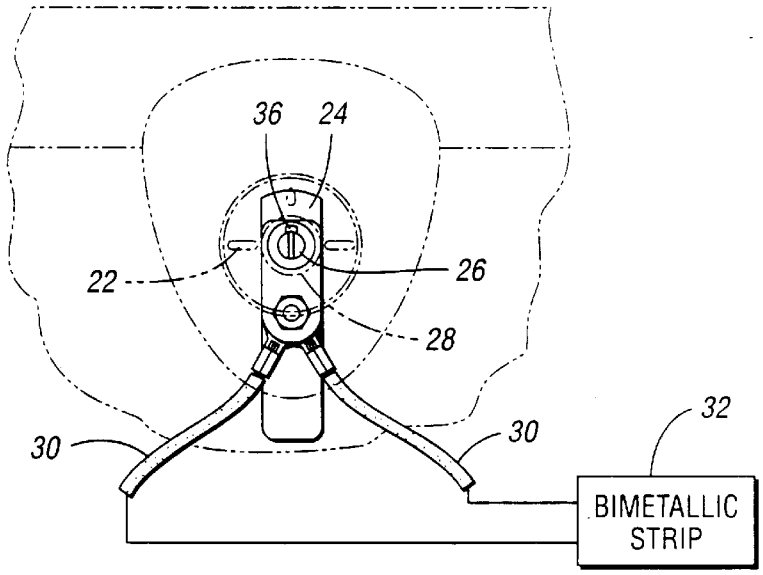
FIG. 2 is a fragmentary front elevation view partially in phantom of a potentiometer.

Referring now to FIG. 2, a potentiometer 24 is adjusted by the knob 10 that is connected to a shaft 26. The shaft 26 extends through an opening 28 in the control panel 12. The potentiometer 24 is connected by wires 30 to a bimetallic strip 32. The shaft 26 has a rib 36 that is engaged by the knob 10.

Figure 3:
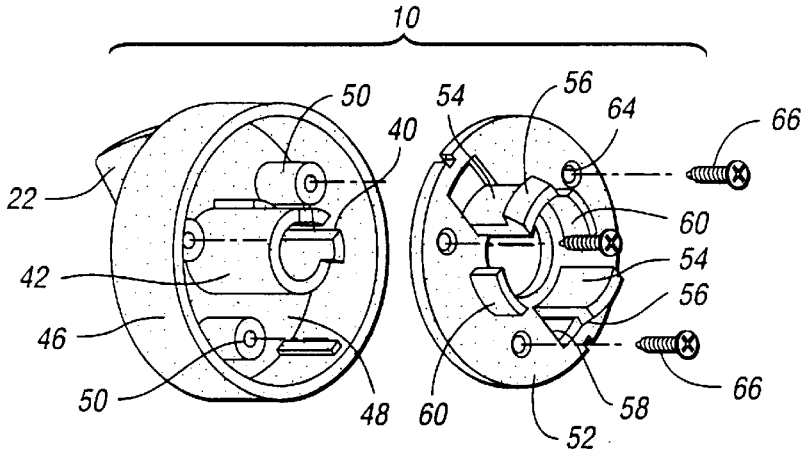
FIG. 3 is an exploded perspective view of a knob.

As shown in FIG. 3, the knob assembly 10 includes a slot 40 in which the rib 36 is received. The slot 40 is formed in a tubular portion 42 of the knob that is sized to be received over the shaft 26. The knob 10 also includes a tubular outer part 46 that is closed on one end by end wall 48. Fastener bosses 50 extend from the end wall 48. A disk 52 forms a second part of the knob assembly 10. The disk 52 includes projections 54 having detents 56 that engage the opening 28 for the shaft 26 in the control panel 12. The detents 56 retain the knob on the control panel.

Figure 4:
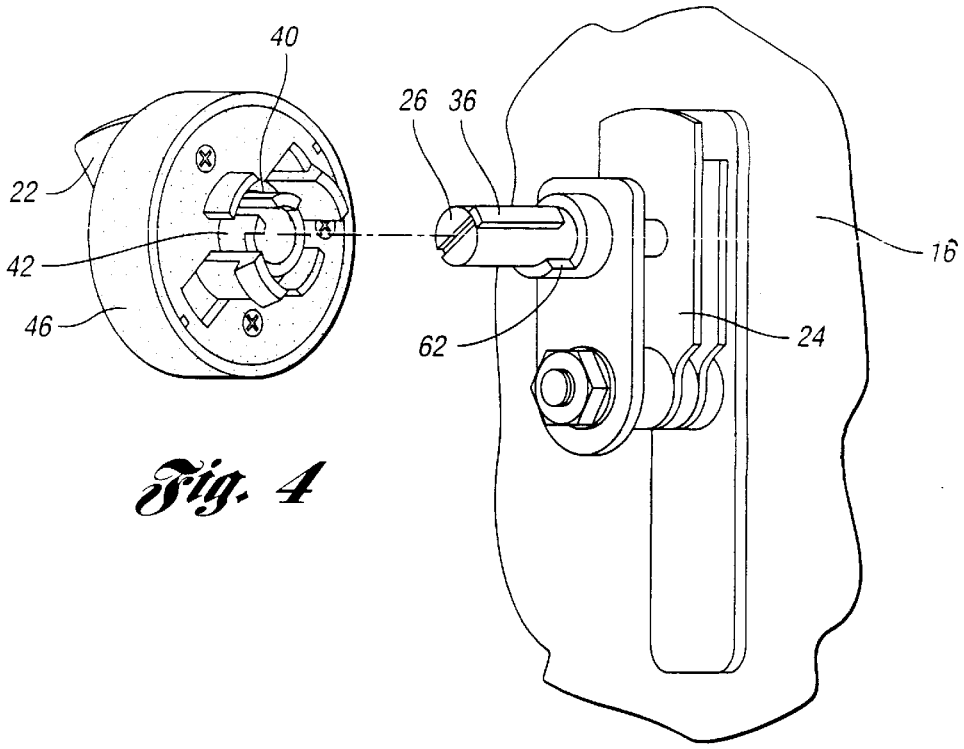
FIG. 4 is a perspective view of a potentiometer and knob.

The projections 54 extend from openings 58 in the disk. End stops 60 are provided at spaced locations on the disk 52. The end stops 60 rotate with the knob and engage fixed stops 62 that are located adjacent the shaft 26, as shown in FIG. 4. The fixed stops 62 are engaged by the end stops 60 as the knob is rotated in a limited arcuate path that defines the limits of rotation of the shaft 26. The disk 52 includes openings 64 through which screws 66 are received to secure the disk 52 to the fastener bosses 50 of the tubular outer part 46 of the knob assembly 10.

With continuing reference to FIG. 4, the potentiometer 24 is controlled by rotating the shaft 26. The slot 40 receives the rib 36. As the knob 10 is rotated, the rib 36 transmits rotational forces to the rib 36 until the end stop 60 engages the fixed stop 62.

Figure 5:
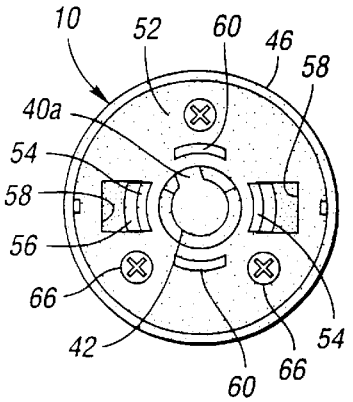
FIGS. 5–7 are a series of rear elevation views of a knob showing variations in the knob construction that are used to compensate for variations in the bimetallic opening point.
Figure 6:
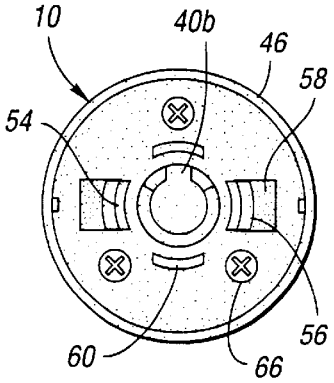
Figure 7:
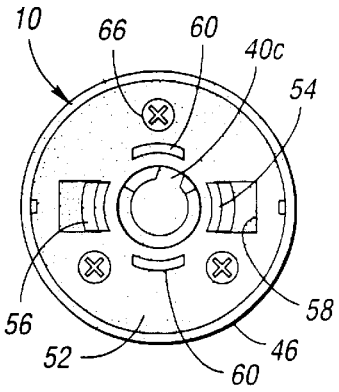

Referring now to FIGS. 5 through 7, a series of views are provided to illustrate the mechanism by which the knob assembly 10 can be adapted to compensate for variations in the opening temperature of the bimetallic strip 32. As shown in FIG. 5, the slot 40*a* is shown offset in the counterclockwise direction as shown in the tubular portion 42. As shown in FIG. 5, the knob is seen from the inside. If the knob was viewed from the exterior of the offset would be in the clockwise direction. By changing the radial location of slot 40*a*, the position that the rib 36 is received in the slot 40*a* is shifted in the clockwise direction. This also changes the relationship of the rib 36 to the fixed stop 62.

Referring now to FIG. 6, the slot 40*b* is shown shifted relative to the position of slot 40*a*. In FIG. 7, the slot 40*c* is further shifted in the clockwise direction, as shown, that would cause the rib 36 to be engaged by the slot 40*c* in a radially shifted location, causing the rib 36 to be shifted counterclockwise relative to the fixed stop 62.

Accordingly, the knob assembly 10 can be provided in several different arrangements to change the relative location of the slot 40*a*, 40*b*, 40*c* that, in turn, changes the angular orientation of the shaft 26 and the rib 36 relative to the fixed stop 62. Bimetallic strips having a temperature variation greater than the desired variation for the product such as a paraffin bath are tested 100% and sorted into high-range, mid-range and low-range groups. The knob assembly 10 is then selected having one of the slots 40*a*, 40*b*, or 40*c* to adjust the potentiometer compensating for the opening temperature of the bimetallic strip, depending on whether the bimetallic strip 32 falls in the low, mid or high range.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. In combination, thermostatic control and a heating appliance comprising:

an electrical circuit for controlling the heating appliance;

a bimetallic element in the circuit that opens when a temperature level is obtained;

a potentiometer in the circuit for selecting the temperature level within an acceptable range of temperatures, the potentiometer having a rotatable shaft having a first positioning element; and a knob secured to the shaft and having a second positioning element that is located in one of a plurality of different positions relative to the knob for engaging the first positioning element, the knob being selected so that the location of the second positioning element thereof compensates for variations in the temperature at which the bimetallic element opens.

2. The combination of claim 1 wherein the first positioning element is a rib and the second positioning element is a tubular portion of the knob having a slot that receives the first positioning element.

3. The combination of claim 2 wherein the slot may be located within a range of radial locations.

4. The combination of claim 3 wherein the slot may be located in one of three positions to permit matching to the bimetallic element according to whether it has a low-range temperature opening, mid-range temperature opening, or high range temperature opening point.

5. The combination of claim 1 wherein the heating appliance has a housing with at least one fixed stop and wherein the knob has at least one end stop that cooperates with the fixed stop to limit rotational movement of the rotatable shaft.

6. The combination of claim 1 wherein the heating appliance has a control panel having an opening through which the knob connects to the rotatable shaft, such knob having projections including detents that rotatably secure the knob to the opening in the control panel.

7. The combination of claim 1 wherein the bimetallic element has a rated tolerance within a first range of temperatures and the range of acceptable temperatures for the heating element is less than the first range, wherein the portions of the first and second positioning elements may be used to calibrate the potentiometer to match the acceptable range of temperatures.

8. The combination of claim 1 further comprising a knob having an outer part defining a cavity and an inner part comprising a disk received within the cavity.

9. The combination of claim 8 wherein the outer part defining a cavity includes a tubular portion and the inner part defines two end stops.

* * * * *